United States Patent [19]

Nyzen

[11] Patent Number: 4,896,853

[45] Date of Patent: Jan. 30, 1990

[54] TRASH BAG HOLDER

[76] Inventor: Richard C. Nyzen, 620 Merriman Rd., Akron, Ohio 44303

[21] Appl. No.: 302,778

[22] Filed: Jan. 30, 1989

Related U.S. Application Data

[63] Continuation of Ser. No. 95,664, Sep. 14, 1987, abandoned.

[51] Int. Cl.[4] ..... B65B 67/12

[52] U.S. Cl. ..... 248/97; 248/147; 248/100; 248/150

[58] Field of Search ..... 248/97, 95, 98, 99, 248/100, 101, 122, 147, 150, 417; 294/1.1; 220/404, 287

[56] References Cited

U.S. PATENT DOCUMENTS

| | | | |
|---|---|---|---|
| 558,531 | 4/1896 | Tarr | 248/99 |
| 1,210,284 | 12/1916 | Entwistle | 220/287 X |
| 1,351,094 | 8/1920 | Buckel | 248/99 |
| 1,827,495 | 10/1931 | Tippett | 248/99 |
| 2,995,329 | 8/1961 | Talcott, Jr. | 248/97 |
| 3,773,286 | 11/1973 | Govoni et al. | 248/97 |
| 3,796,402 | 3/1974 | Trotta | 248/97 |
| 3,916,962 | 11/1975 | Stolt | 248/101 X |
| 4,159,139 | 6/1979 | Gawedzinski | 248/101 X |
| 4,269,441 | 5/1981 | Hirsch | 294/1.1 |
| 4,629,233 | 12/1986 | Pfisterer | 294/1.1 |
| 4,659,045 | 4/1987 | Flynn | 294/1.1 X |

FOREIGN PATENT DOCUMENTS

| | | | |
|---|---|---|---|
| 1329 | 1/1914 | United Kingdom | 248/97 |

*Primary Examiner*—Ramon S. Britts
*Assistant Examiner*—Karen J. Chotkowski
*Attorney, Agent, or Firm*—Renner, Kenner, Greive, Bobak, Taylor & Weber

[57] ABSTRACT

An apparatus for holding bags or the like (10), includes a stand (11), a first arm (14), a second arm (18), and a plurality of attaching means (24). The first arm (14) is demountably attached to an upstanding support (12) of stand (11), and the upstanding support is held upright by a base (13). The second arm (18) is pivotably connected to the first arm (14) and biasing means (20) mounted therebetween tend to force the second arm (18) to its open position. The second arm (18) can also be maintained in mating juxtaposition with the first arm (14) and thereby serves to temporarily close a bag (23) which is supported by holder (10), or if desired, a closure (30) may be provided. Holder (10) can be disassembled and first arm (14) removed from upstanding support (12). A dust pan (17) carried by first arm (14) can be positioned at different elevations including the floor.

17 Claims, 3 Drawing Sheets

TRASH BAG HOLDER

TECHNICAL FIELD

This is a continuation of application Ser. No. 095,664 filed Sept. 14, 1987, and now abandoned.

This invention relates to an apparatus for supporting bags, in particular plastic or paper trash bags. More particularly, this invention relates to a trash bag holder which provides upstanding support for plastic trash bags and the like but which is easily movable.

BACKGROUND ART

Trash bags, typically of a flexible plastic or paper construction, are incapable of standing in an open upright position without assistance or support. In general, this disadvantage requires the use of a rigid trash container in which the bag is placed so that the open end of the bag engages the open end of the container. These containers are typically movable only with great difficulty due to their rigid construction. Further, such containers are not easily manipulated so that the trash bag opening may be placed adjacent to a surface at an elevation different than to top of the container, such as the floor, ground or counter. For example, often it is desirous to place materials that have been gathered or swept from a floor surface into a trash bag. With use of a conventional trash container, the material to be discarded must be lifted from the floor to the container through use of a dust pan or other similar device, inasmuch as the open end of the container housing the bag is incapable of conveniently being positioned adjacent to the floor.

Often these difficulties are avoided by having one person hold the bag in an open fashion while another person places the trash therein. While providing superior mobility, obviously this approach is less efficient.

One attempt at a more efficient trash bag container comprises a plastic sheet of a rigid material which is capable of being rolled. The rolled sheet is placed inside a trash bag and allowed to unroll, thereby forming a cylindrical container bounded by the trash bag itself. The sheet supports the bag in an open position and is removed when the bag is full. The mobility of such a structure is, however, limited.

It is also known to place a trash can or the like upon a movable dolly of some sort. In some such constructions the trash bag is supported by an annular ring which is carried upon a movable cart. The opening of a trash bag engages the annular ring, much as the bag would engage the top of a trash container, and is fixed thereto by action of a nylon rubber band or other elastic material. A problem with this construction is that the bag, while supported in an open position, is relatively immovable with respect to the cart upon which it is located. Moreover, positioning the bag opening adjacent to surfaces at an elevation different than that of the annular ring is difficult, if not impossible.

Another problem with most of these foregoing constructions is that the bag contained therein remains open until it is full, at which time it may be closed and secured. Such practice is undesirable, especially if the trash discarded in the bag begins to develop an unpleasant odor. No portable trash bag holder, of which I am aware, is provided with any means to temporarily close the same during use.

Thus, while the art has provided ameliorations over the drawbacks of the typical trash holder, a truly mobile or portable trash bag holder continues to remain a problem.

DISCLOSURE OF THE INVENTION

It is therefore a primary object of the present invention to provide a truly mobile or portable trash bag holder.

It is another object of the present invention to provide a trash bag holder, as above, wherein the trash bag opening is capable of being moved so that it is adjacent a surface which is disposed at an elevation different than that of the trash bag in its upright position.

It is a further object of the present invention to provide a trash bag holder, as above, wherein accessories, such as a dust pan, may be attached thereto.

It is yet another object of the present invention to provide a trash bag holder, as above, which is of a lightweight construction such that it is easily movable.

It is still a further object of the present invention to provide a trash bag holder, as above, wherein the trash bag may be temporarily closed with ease.

These and other objects of the present invention which will become apparent from the description to follow, are accomplished by the means hereinafter described and claimed.

In general, the trash bag holder includes a stand member carrying a first arm. A second arm is pivotally attached to the first arm with biasing means interposed between the first and second arms. The trash bag is carried by a plurality of attachment mechanisms on the first and second arms so that when the arms are spread apart by the biasing means, the top of the bag is open for the receipt of trash.

PREFERRED EMBODIMENT FOR CARRYING OUT THE INVENTION

Figure 1:
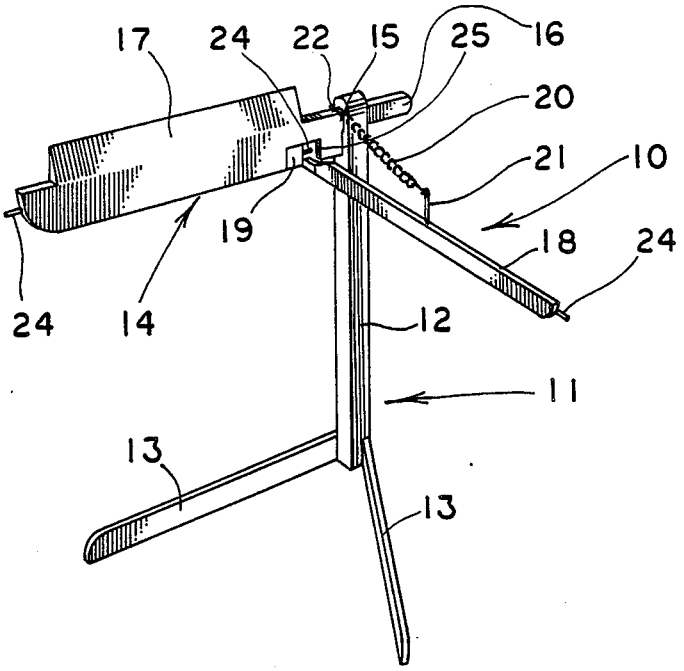
FIG. 1 is a perspective view of the trash bag holder according to the concept of the present invention with the arms thereof in an open position, showing one of the arms partially broken away.

An apparatus for holding bags, such as trash bags or the like, is indicated generally by the numeral 10 in the drawings. Trash bag holder 10 is shown in FIG. 1 as including a stand indicated generally by the numeral 11 and including an upstanding vertical support member 12 attached to a base which, as shown best in FIG. 1, may be formed of support legs 13 shown as being arranged angularly to each other with each being attached to upstanding support 12. Trash bag holder 10 can be made of any suitable material including wood, plastic or metal, or any combination thereof. It is desirable however, that it be of light-weight construction so that it may be lifted with ease.

An arm indicated generally by the numeral 14 is cantilevered from upstanding support 12 and extends outward from upstanding support 12 approximately the same distance from upstanding support 12 as do support legs 13. Arm 14 may be suitably configured so as to extend through a slot 15 in upstanding support 12 thereby forming handle 16 on the opposing side, such as shown in FIG. 1. Handle 16, however, may also be formed as a separate element from arm 14 and as such can be attached to upstanding support 12 in any conventional manner. As will hereinafter be described, handle 16, regardless of its form, serves to enable the user to move at least a portion of trash bag holder 10 to a variety of positions.

Arm 14 may carry an attachment, for example in the form of a dust pan 17, which assists in placing trash in the bag held in holder 10. The attachment is preferably located approximately midway between the outer end of arm 14 and upstanding support 12. As shown in FIG. 1, dust pan 17 can be formed integrally of arm 14, or it may also be a separate element which can be attached to arm 14 in any conventional manner. Likewise, any other attachment which may be desired, such as a shovel, may be a separate element of arm 14 or formed integrally therewith.

Figure 2:
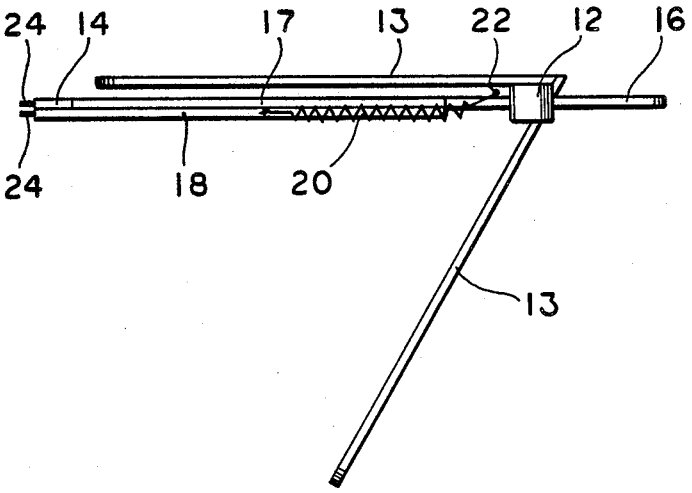
FIG. 2 is a top plan view of the trash bag holder shown with the arms thereof in a closed position and without a bag.

A swingable arm 18 is attached, as by hinge 19, to arm 14 at a point adjacent to upstanding support 12. The pivotal attachment of swingable arm 18 permits movement between a closed position where arms 18 and 14 are parallel and juxtaposed with each other, as shown in FIG. 2, and a fully open position where arm 18 is generally perpendicular to arm 14, as shown in FIG. 1. Swingable arm 18 is therefore pivotal to a number of different angular positions with respect to arm 14, namely from approximately 0° to approximately 90°. In operation, as will be discussed more fully hereinbelow, such pivotal movement enables the temporary opening or closure of a trash bag which may be held or supported by apparatus 10.

Figure 3:
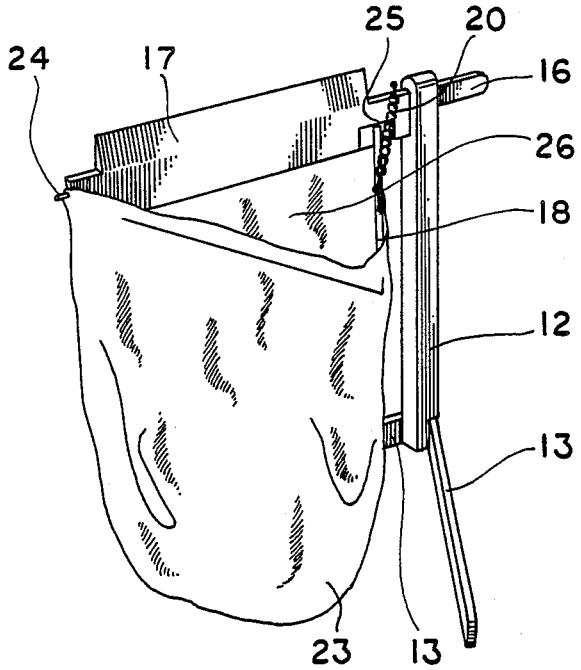
FIG. 3 is a perspective view of the trash bag holder shown at a different angle than FIG. 1 and shown carrying a bag.

A spring 20 is attached between a bracket 21 extending upwardly from arm 18 and a bracket 22 mounted on the back of arm 14 near upright support 12 so as to bias arm 18 with respect to arm 14. Spring 20 is attached so that its most relaxed or compressed position is obtained when swingable arm 18 is fully open or at 90° with respect to arm 14. As such, movement of arm 18 toward arm 14, as in moving arm 18 from its position of FIG. 1 to that of FIG. 2, is restrained due to the force of spring 20 which tends to draw arm 18 to its open position. The force of spring 20 is of a sufficient magnitude to hold a bag 23, attached to arms 14 and 18 in a manner to be hereinafter described, open, as shown in FIG. 3, but insufficient to cause breakage of bag 23. Although spring 20 is shown as a conventional spiral spring, any elastic material which suitably biases arm 18 with respect to arm 14 is within the spirit of this invention.

Trash bag 23 can be attached to holder 10 by means of hooks 24 which are carried by arms 14 and 18. It is desirable to have a plurality of hooks 24, or other attaching devices, so that bag 23 is securely attached to apparatus 10. The precise placement and number of hooks 24 may vary as differences in loads are encountered. Three hooks are shown in the drawings with one being carried on the outermost tip of arm 18, one being carried on the outermost tip of arm 14, and one being carried in a notch 25 in arm 14 just outside of handle 16, which notch and hook are visible in FIG. 1 because arm 18 is partially broken away at the area of hinge 19. Hooks 24 may be made of any suitable material including wood, plastic, or metal and serve to attach bag 23 to the trash bag holder 10, as by piercing through the plastic bag.

In operation, bag 23 is opened so that the top portion thereof may be fitted about trash bag holder 10. With arms 18 and 14 at least partially separated, the top portion of bag 23 can be fitted about arms 14 and 18 with the lip thereof extending through notch 25 so that all three hooks 24 may be engaged, as by piercing the bag near the top periphery thereof preferably at three points on the bag approximately 120° of each other.

Under the influence of spring 20, bag 23, supported by holder 10, is opened as arm 18 moves away from arm 14. Such movement, however, is restrained by the dimensions of bag 23 which is now in an open position such as depicted in FIG. 3 with the opening 26 in bag 23 being generally in the form of an equilateral triangle. Trash may then be placed within bag 23 through opening 26. If desired, bag 23 may be temporarily closed simply by moving arm 18 into mating juxtaposition with arm 14. Because the mounting of spring 20 on bracket 22 is on the back side of arm 14, that is, behind hinge 19, the over-the-center action of spring 20 will tend to keep bag 23 closed. As bag 23 becomes more full, a different closure arrangement, shown in FIGS. 5–7, inclusive, to be hereinafter described, may be utilized.

Figure 4:
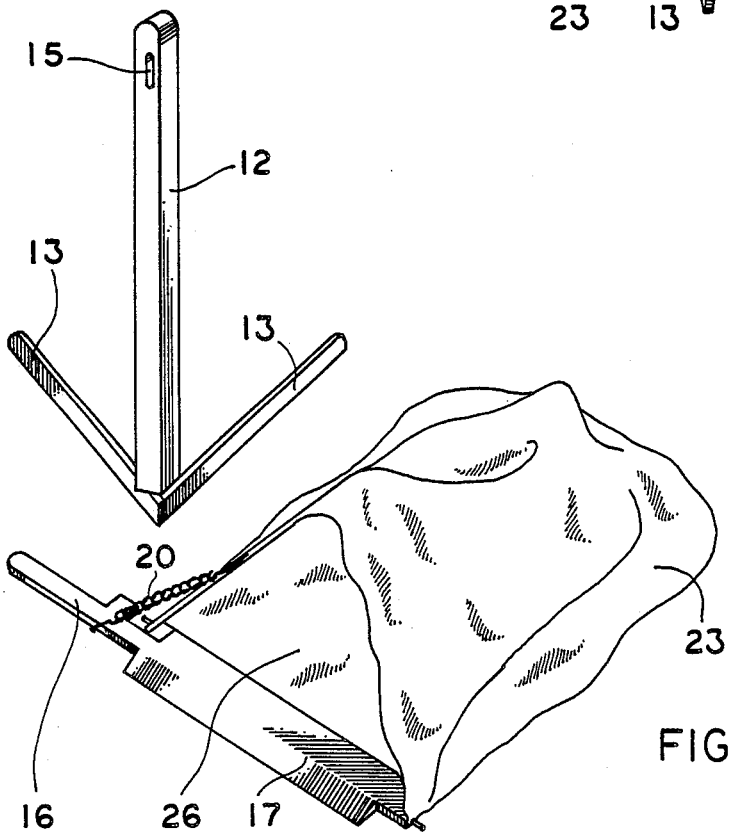
FIG. 4 is a perspective view showing the manner in which one of the arms of the trash bag holder can be removed so that the opening of the bag can be positioned at the level of the ground.

Holder 10 may at any time be moved to any desired location simply by lifting handle 16. Such action enables movement of holder 10 in both its assembled configuration or its disassembled configuration, the latter of which will now be described. Arm 14, in the preferred embodiment, may be removed from upright support 12 with swingable arm 18 pivotally attached thereto and bag 23 secured to the combination, such as shown in FIG. 4. Removal of arm 14 is easily achieved inasmuch as handle 16 can be slidably removed through slot 15 in upstanding support 12.

Once arm 14 is removed from upstanding support 12, bag 23, which is in its open posture, can be positioned at a number of different elevations. As shown in FIG. 4, arm 14 can be positioned on the floor or ground with dust pan 17 contiguous with that surface. Trash or other items may then be swept, or otherwise scooped, over dust pan 17 into opening 26 of bag 23. Arms 14 and 18 which support bag 23 could then be moved wherever desired. In this manner, opening 26 of bag 23 can be easily positioned at a wide variety of locations, thus simplifying the task of placing trash in supported bag 23. Moreover, if desired, bag 23 could be temporarily closed, as described hereinabove, with holder 10 in this disassembled configuration.

Once bag 23 is full, it may be removed from holder 10 and disposed of properly. Removal of bag 23 can be accomplished with arms 14 and 18 either in the open or closed position. A new bag 23 can then be attached to holder 10 and used in accordance with the concepts of the present invention.

As previously indicated, bag 23 may be temporarily closed during use by folding arm 18 inwardly against arm 14 in the position shown in FIG. 2. As bag 23 becomes close to being filled with trash, such a procedure might not fully close the same and thus for this situation or for any instance when a closure is desired, a cover assembly, indicated generally by the numeral 30 and shown in FIGS. 5–7, can be provided.

Closure 30 includes a triangular shaped cover plate 31 designed of such a size such that it would generally correspond to the triangular opening 26 of bag 23 formed when bag 23 is positioned on holder 10. However, because the size of opening 26 may vary somewhat dependent, for example, on how equally spaced the user pierces the bag with hooks 24, closure 30 is provided with a size adjustment arm 32 pivotally mounted, as at 33, to cover plate 31. Arm 32 carries, at its outer end, a hook 34 which is adapted to rest on the outer end of arm 14 of holder 10. Cover plate 31 is also provided with tabs 35 affixed thereto and extending outwardly therefrom. Tabs 35 rest on swingable arm 18 when plate 31 is positioned on holder 10. Thus, hook 34 and tabs 35 support closure 30 on holder 10 to close opening 26 in bag 23.

Figure 5:
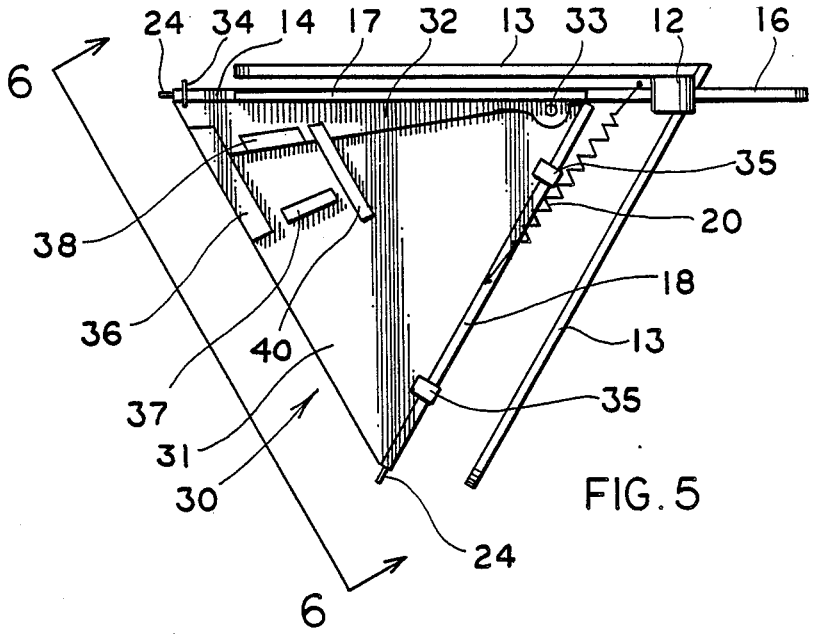
FIG. 5 is a top plan view of the trash bag holder showing a cover in place over the bag.
Figure 6:
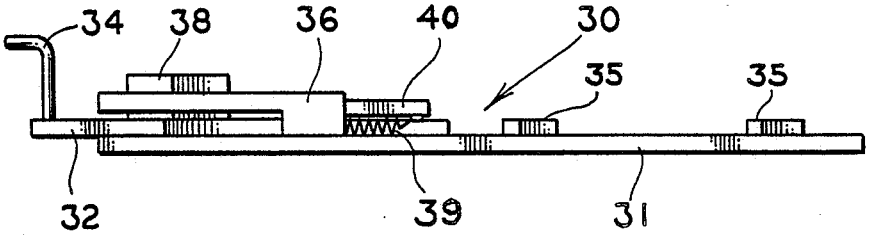
FIG. 6 is an enlarged elevational view of the cover taken substantially along line 6—6 of FIG. 5.
Figure 7:
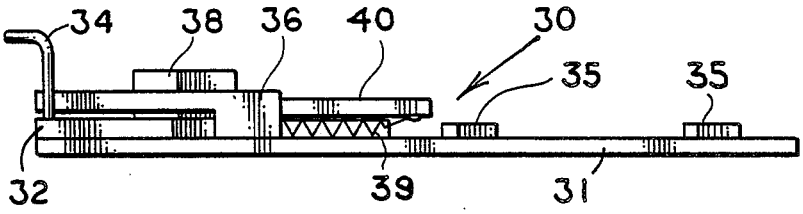
FIG. 7 is a view similar to FIG. 6 but showing the mechanisms of the cover in a different operating position.

Size adjustment arm 32 is movable on pivot 33 from a fully extended position shown in FIGS. 5 and 6 to a fully retracted position shown in FIG. 7 underneath a guide bracket 36 mounted on plate 31. A stop block 37 mounted on plate 31 limits the inward movement of arm 32. A handle 38 on arm 32 facilitates movement of the same such that the user merely need only grasp handle 38 and retract arm 32 beneath guide bracket 36.

Size adjustment arm 32 is biased outwardly by a coil spring 39 (FIGS. 6 and 7) mounted between plate 31 and a spring holding bracket 40 extending over plate 31 from arm 32. Thus, arm 32 is normally positioned in the fully extended position shown in FIG. 6 and when moved inwardly to the FIG. 7 position, the bias of spring 39 is overcome and it is extended.

To properly position closure 30 on holder 10, the user need only grasp handle 38 and hold arm 32 in the position shown in FIG. 7. Then tabs 35 may be rested on arm 18 and handle 38 released permitting arm 32 to swing outwardly until hook 34 may engage arm 14. Closure 30 can thus be utilized for triangular bag openings 26 of varying sizes.

It should thus be appreciated that the mobile trash bag holder according to the concept of the present invention represents a substantial improvement in the art and otherwise accomplishes the objects of the present invention. While the preferred embodiment of the present invention has been described herein, the teachings herein are not intended to be so restricted. Modifications of the preferred embodiment which might utilize the teachings of the present invention are also intended to be within the scope of the present invention.

I claim:

1. Apparatus for supporting bags or the like comprising: stand means, a first arm carried at one end by said stand means, a second arm pivotally attached to one side of said first arm, means carried on said first and second arms for attaching a bag thereto so that when said second arm is swung away from said one side of aid first arm the bag is open and when said second arm is adjacent to said one side of said first arm the bag is closed, and biasing means having one end mounted to an other side of said first opposite said one side between said one end of said first arm and a point of pivotal attachment of said second arm to said first arm, the other end of said biasing means being attached to said second arm, said biasing means maintaining said second arm swung away said one side of said first arm to keep the bag in the open position and maintaining said second arm adjacent to said one side of said first arm to keep the bag in the closed position.

2. Apparatus for supporting bags or the like as in claim 1, wherein said stand means includes a base and an upstanding support generally perpendicular to said base.

3. Apparatus for supporting bags or the like as in claim 2, wherein said base includes at least two legs disposed angularly to each other.

4. Apparatus for supporting bags or the like as in claim 2, wherein said first arm is demountably attached to said upstanding support for removal therefrom.

5. Apparatus for supporting bags or the like as in claim 4, wherein said first arm includes a handle member which engages said upstanding support.

6. Apparatus for supporting bags or the like as in claim 5, wherein said means carried on said first and second arms include hook means to pierce the bag located approximately at the ends of said first and second arms and adjacent said handle member.

7. Apparatus for supporting bags or the like as in claim 1, further comprising means attached to said first arm to assist in placing trash in the bag.

8. Apparatus for supporting bags or the like as in claim 7, wherein said means attached to said first arm is in the form of a dust pan.

9. Apparatus for supporting bags or the like as in claim 1, wherein the angle between said second arm and said first arm is approximately 60 ° when said second arm is swung away from said first arm thereby forming a triangular opening in the bag.

10. Apparatus for supporting bags or the like as in claim 1, wherein said means carried on said first and second arms include hook means to pierce the bag.

11. Apparatus for supporting bags or the like comprising stand means, a first arm carried by said stand means, a second arm pivotally attached to said first arm, biasing means mounted between said first arm and said second arm, means carried on said first and second arms for attaching a bag thereto wherein a generally triangularly shaped opening is formed in the bag when the bag is attached to said first and second arms, a generally triangularly shaped closure including a plate for closing the opening, and means to adjust the generally triangular attached to said plate.

12. Apparatus for supporting bags or the like as in claim 11 further comprising means on said plate to engage said second arm and means on said means to adjust to engage said first arm.

13. Apparatus for supporting bags or the like as in claim 11 further comprising means to bias said arm of said means to adjust outwardly of said plate.

14. Apparatus for supporting bags or the like as in claim 13 further comprising a bracket mounted on said arm of said means to adjust, said means to bias being mounted between said bracket and said plate.

15. Apparatus for supporting bags or the like comprising a first arm having an inner and outer end a second arm pivotally attached to said first arm near the inner end thereof so that said second arm may swing away from one side of said first arm, biasing means mounted between said first arm and said second arm to selectively maintain said second a arm adjacent to or swung away from said one side of said first arm, said biasing means being attached to said first arm on an other side of said first arm opposite said one side other side at a point between the inner end thereof and the point where said second rm is pivotally attached to said first arm and being attached to said second arm generally midway of the length thereof, and means carried on said first and second arms for attaching a bag thereto, the bag being attached such that a generally triangular opening is formed therein.

16. Apparatus for supporting bags or the like as in claim 15 further comprising means attached to said first arm to assist in placing trash in the bag.

17. Apparatus for supporting bags or the like as in claim 15 wherein said means carried on said first and second arms includes means to pierce the bag located approximately at the ends of said first and second arms.

* * * * *

UNITED STATES PATENT AND TRADEMARK OFFICE

CERTIFICATE OF CORRECTION

PATENT NO. : 4,896,853

DATED : January 30, 1990

INVENTOR(S) : Richard C. Nyzen

It is certified that error appears in the above-identified patent and that said Letters Patent is hereby corrected as shown below:

Column 5, line 58, claim 1, "aid" should read --said--.

Column 5, line 62, claim 1, following the word "first" insert the word --arm--.

Column 5, line 67, claim 1, after the word "away" insert the word --from--.

Column 6, line 45, claim 11, before the word "attached" insert --shape of said closure including an arm pivotally--.

Column 6, line 63, claim 15, between the words "second" and "arm" delete the word --a--.

Column 6, lines 66-67, claim 15, delete the words "other" and "side".

Column 6, line 68, claim 15, following the word "second" the letters "rm" should read --arm--.

Signed and Sealed this

Twenty-sixth Day of March, 1991

*Attest:*

HARRY F. MANBECK, JR.

*Attesting Officer*

*Commissioner of Patents and Trademarks*